United States Patent [19]

Tocco

[11] 4,207,799

[45] Jun. 17, 1980

[54] MUZZLE BRAKE

[76] Inventor: Charles T. Tocco, 21908 Dequindre, Lot 35, Warren, Mich. 48091

[21] Appl. No.: 949,416

[22] Filed: Oct. 10, 1978

Related U.S. Application Data

[63] Continuation of Ser. No. 768,072, Feb. 14, 1977, abandoned.

[51] Int. Cl.[2] ..... F41C 21/18

[52] U.S. Cl. ..... 89/196; 89/14 C

[58] Field of Search ..... 42/79; 89/14 C, 16, 89/163, 196

[56] References Cited

U.S. PATENT DOCUMENTS

| | | | |
|---|---|---|---|
| 858,745 | 7/1907 | McClean | 89/14 C |
| 1,415,919 | 5/1922 | Butler et al. | 89/14 C |
| 2,322,370 | 6/1943 | Lance | 89/14 C |
| 2,935,000 | 5/1960 | Mowrey | 89/14 C |
| 3,641,870 | 2/1972 | Eig | 89/16 |

FOREIGN PATENT DOCUMENTS

| | | | |
|---|---|---|---|
| 911049 | 6/1946 | France | 89/14 C |

*Primary Examiner*—Stephen C. Bentley
*Attorney, Agent, or Firm*—Remy J. VanOphem

[57] ABSTRACT

A generally tubular member is provided at one end thereof with securing means for detachably securing such member as to a pistol type firearm and to be generally aligned with the bore of such firearm, forwardly thereof; the tubular member has aperture or porting means formed in a selected portion of the wall forming the tubular member whereby gases, generated during the ignition of a related bullet assembly, may escape in a generally upwardly direction thereby creating generally downwardly directed reaction forces assisting in maintaining the fired firearm stable and at least significantly eliminate the usually experienced sudden upward jump of such fired firearm.

13 Claims, 18 Drawing Figures

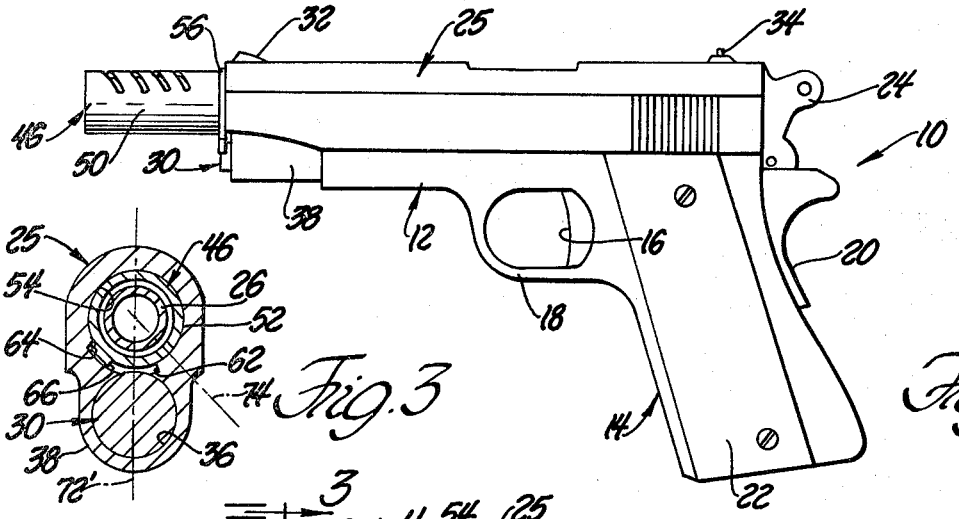
Fig. 1
Fig. 3
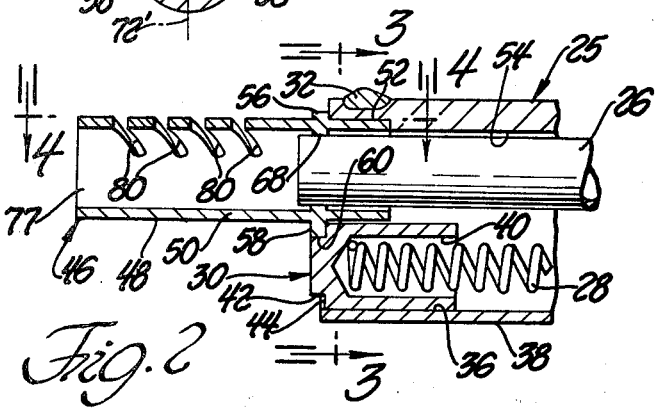
Fig. 2
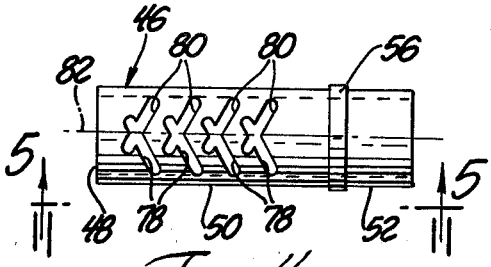
Fig. 4
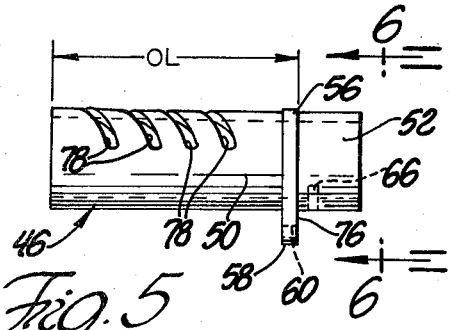
Fig. 5
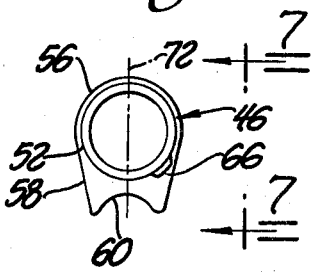
Fig. 6
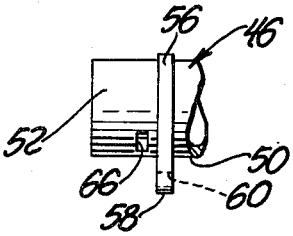
Fig. 7
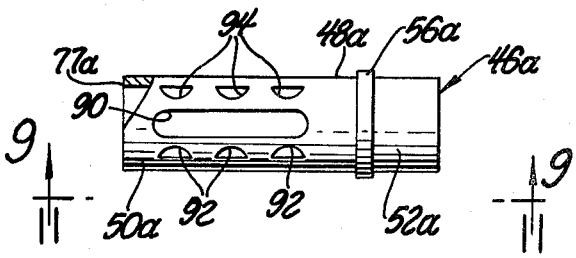
Fig. 8

MUZZLE BRAKE

This is a continuation, of application Ser. No. 768,072, filed Feb. 14, 1977, now abandoned.

BACKGROUND OF THE INVENTION

It is common knowledge that both hand guns and long guns, when fired, create a resulting reaction force driving such firearm upwardly. That is, hand guns have a generally downwardly depending hand grip which, when held, places the gun barrel at an elevation above the hand. Accordingly, when such hand gun is fired, the reaction forces create a force moment couple tending to twist or rotate the gun as to cause the muzzle to move upwardly. This form of action and reaction also applies to long guns which have a gun stock held against the person's shoulder when firing. In order to provide for aiming, etc., the long gun barrel is also at an elevation above that at which the gun stock abuts against the person's shoulder. The upward twisting motion of the firearm is often referred to as the upward kick of the gun.

Such upward kick occurs so quickly that the bullet passing through the barrel is actually still in the process of escaping the barrel muzzle when the upward kick occurs and, in the past, those thusly firing such firearms would have to learn to try to compensate for the error thusly imparted to the bullet as by aiming the firearm at a point elevationally below that which was intended to be struck by the bullet.

Various means and techniques have been employed by the prior art in an attempt to overcome such upward kicks. One such prior art attempt was to actually machine holes in the gun barrel as to have such holes at opposite sides of the centerline of such gun barrel and at the generally upper portion thereof. This is a very expensive process of gun alteration and even though not understood why, such attempts have not proven to be satisfactory because such altered guns still exhibit a high degree of upward kick. Another technique employed with respect to hand guns is to hold such gun with both hands and with the arms extended in an attempt to physically overcome the force generating the upward kick. Neither of such means or techniques have proven to be successful. Further, especially with regard to slide-type automatic pistols, the prior art has failed to provide any real solution to the upward kick.

Accordingly, the invention as herein disclosed, described and claimed is primarily directed to the solution of the foregoing and attendant problems.

SUMMARY OF THE INVENTION

According to the invention a firearm muzzle-type brake comprises a generally tubular member having provided at or near one end thereof securing means effective for detachably securing such member to a related firearm in a manner as to have such tubular member generally aligned with the bore of said firearm and forwardly thereof; the tubular member has aperture or porting means formed in a selected portion of the wall forming the tubular member whereby gases, generated during the ignition of a related bullet assembly, may escape in a generally upwardly direction thereby creating generally downwardly directed reaction forces assisting in maintaining the fired firearm stable to at least significantly minimize the otherwise full upward kick of the fired firearm.

Various general and specific objects and advantages of the invention will become apparent when reference is made to the following detailed description considered in conjunction with the accompanying drawings.

BRIEF DESCRIPTION OF THE DRAWINGS

In the drawings, wherein for purposes of clarity certain details may be omitted from one or more views:

FIG. 1 is a side elevational view of a slide-type automatic pistol equipped with a muzzle brake embodying teachings of the invention;

FIG. 2 is an enlarged fragmentary portion of the structure of FIG. 1 with portions thereof shown in cross-section;

FIG. 3 is a transverse cross-sectional view taken generally on the plane of line 3—3 of FIG. 2 and looking in the direction of the arrows;

FIG. 4 is a generally top plan view, of one of the elements of FIG. 3, taken generally on the plane of line 4—4 of FIG. 2 and looking in the direction of the arrows;

FIG. 5 is a side elevational view taken generally on the plane of line 5—5 of FIG. 4 and looking in the direction of the arrows;

FIG. 6 is a view taken generally on the plane of line 6—6 of FIG. 5 and looking in the direction of the arrows;

FIG. 7 is a fragmentary view taken generally on the plane of line 7—7 of FIG. 6 and looking in the direction of the arrows;

FIG. 8 is a view similar to that of FIG. 4 but illustrating another embodiment of a muzzle brake embodying teachings of the invention;

DETAILED DESCRIPTION OF THE PREFERRED EMBODIMENTS

Figure 9:
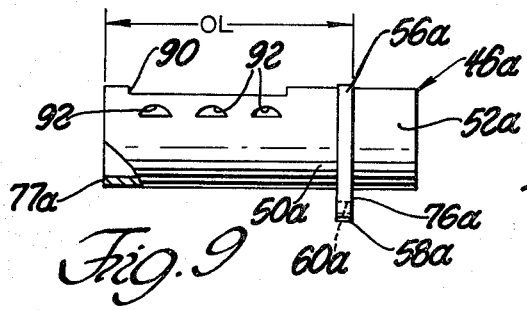
FIG. 9 is a view taken generally on the plane of line 9—9 of FIG. 8 and looking in the direction of the arrows.

Referring now in greater detail to the drawings, FIGS. 1, 2 and 3 illustrate a hand gun 10 is shown as being of the slide action automatic pistol type comprised of, for example, a receiver body or housing 12 having a hand grip portion 14, trigger 16, trigger guard 18, grip safety lever 20, grip stock 22 and hammer 24. A slide 25, carried by the receiver housing 12 also generally contains a barrel 26 therewithin as well as a recoil spring 28 and recoil spring plug 30. Front and rear sights may be provided as at 32 and 34. The general structure and operation of slide-type automatic pistols is well known in the art and suffice it to say that the slide 25 will move axially with respect to the barrel 26 during cocking and firing of the firearm. As generally depicted in FIGS. 1 and 2, the recoil spring 28 and recoil spring plug 30 are received generally between the barrel 26 and receiver 12 with the recoil spring plug 30 being axially received through a forwardly directed open passageway 36 formed in a forward lower depending portion 38 of slide 25.

As will be noted, the spring plug 30 is provided with an axially extended recess or chamber 40 formed in its inner end to receive one end of spring 28 therein, while the outer end of plug 30 is formed with an axially extending cylindrical portion 42 as to thereby define a generally annular shoulder-like area 44 thereabout.

A muzzle brake, embodying teachings of the invention, is shown at 46 as being operatively assembled and secured to the pistol 10. As illustrated in FIGS. 1–7, the muzzle brake 46 is shown as comprising an axially elongated tubular body member 48 with a first body portion 50 intended to be disposed generally forwardly of the pistol 10 and a second body portion 52 intended to be closely slidably received within the cooperating clearance passageway 54 formed in and provided by the slide 25 of the pistol 10. Generally intermediate or joining such inner and outer body portions 52 and 50 is an abutment and locking portion comprised as of an outwardly radiating shoulder 56 which blends with a plate or blade-like radiating extension 58 which has an arcuate recess or relief 60 formed at its generally outermost end.

In the embodiment disclosed, the pistol 10 of of the type which has a bayonet-type locking slot or groove 62 formed at the forward end of the slide 25. Such slot or groove may be the one often employed for axially retaining a forwardly disposed barrel bushing for permitting relative axial motion as between the slide 25 and gun barrel 26. The cross-sectional view of FIG. 3 is one which is taken through such arcuate bayonet-type locking slot 62. Generally, the lowermost (or right-most) portion of such slot would have a forwardly directed clearance opening permitting the insertion therethrough of a related key member which, once received within the slot could be rotated clockwise (as viewed in FIG. 3) as to thereby axially contain such key within the left-most portion of the slot 62.

As best seen in FIGS. 5, 6 and 7, a bayonet locking key portion 66 is formed and carried by rearward or inner body section 52 generally rearwardly of the abutment portion 56. Further, in the preferred embodiment, the contour of arcuate portion 60 closely approximates the cylindrical contour of cylindrical extension 42 of spring plug 30. Also, in the preferred embodiment, the muzzle brake 46 is provided with an internally disposed annular bushing or bearing surface 68 which serves to closely slidingly engage the outer diameter of gun barrel 26.

Generally, the muzzle brake 46 is assembled to the pistol 10 as by inserting inner end 52 of muzzle brake 46 into aperture or passageway 54 of slide 25 in such a manner as to have key 66 aligned with the clearance passageway leading to the arcuate bayonet slot 62. With the muzzle brake 46 thusly positioned and axially pushed toward the slide 25, shoulder or abutment portion 56 will abut against the forward end 70 of slide 25 while key 66 will become positioned within and aligned with the slot 62. At this time, the blade extension 58 will be angularly disposed as to have its mid or medial axis 72 coincident with line 74 as generally depicted in FIG. 3. Once the muzzle brake assumes such position, the spring plug 30 is manually depressed inwardly of slide 25, as to thereby push cylindrical extension 42 out of the path of rotation of blade extension 58. The muzzle brake 46 is then rotated within passage 54, clockwise as viewed in FIG. 3, until the medial axis 72 again assumes a substantially vertical position as generally depicted at 72' of FIG. 3 at which point the spring plug 30 is released resulting in cylindrical extension 42 thereof becoming nested by or peripherally contained by the contoured surface 60 while annular shoulder 44 axially abuts against the juxtaposed axially disposed surface 76 of blade extension 58. It should be apparent that while muzzle brake 46 is thusly being rotated clockwise (from position 74 to position 72'), key means 66 is being simultaneously rotated within arcuate bayonet or key slot 62 towards the opposite end 64 thereof and thereby becoming axially locked within such slot. The cooperative abutting action as between contoured surface 60 and cylindrical extension 42, of course, prevents the unauthorized counter-clockwise rotation (as viewed in FIG. 3) of muzzle brake 46.

As seen in each of FIGS. 1, 2, 4 and 5 the wall structure 77 of muzzle brake 46 has opening means formed therethrough as by a first plurality of slots 78 formed through wall 77 along the generally upper portion of body section 50. As can be seen, a second plurality of slots 80 are also formed through upper portion of body section 50 as to generally meet or interact, respectively, slots 78. As best can be seen in the top plan view of FIG. 4, slots 80 are, in the main, located on one side of a vertical plane passing through the centerline 82, while slots 78 are, in the main, on the other side of such plane. Further, each of the slots or aperture means 78 and 80 are so formed as to be generally inclined, when viewed in FIG. 4, whereby their respective points of meeting or intersection are at distances further from the abutment 56 than the distances at which their respective other ends are from the same abutment means 56.

In FIGS. 8 and 9, all elements shown which are like or similar to those of FIGS. 1–7 are identified with like reference numbers provided with a suffix "a". As can be seen, the muzzle brake **46*a* has aperture or venting means, formed in and through the uppermost portion of body section 48*a*, comprised of a generally medially situated axially elongated slot 90 and a first plurality of axially spaced generally semicircular apertures 92, generally along one side of and spaced from such slot 90, and a second plurality of axially spaced generally semicircular apertures 94 along the other side of and spaced from slot 90**.

Figure 10:
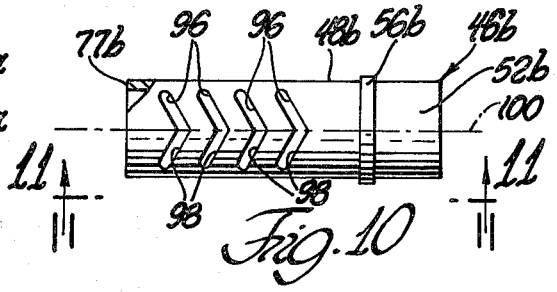
FIG. 10 is a view similar to that of FIG. 8 but illustrating a further embodiment of a muzzle brake embodying teachings of the invention.
Figure 11:
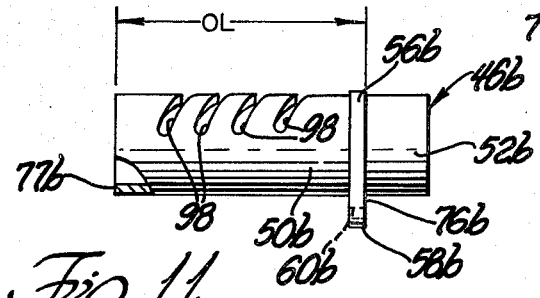
FIG. 11 is a view taken generally on the plane of line 11—11 of FIG. 10 and looking in the direction of the arrows.

In FIGS. 10 and 11, all elements shown which are like or similar to those of FIGS. 1–9 are identified with like reference numbers provided with a suffix "b". As can be seen, the muzzle brake **46*b* has opening or aperture means formed in and through the uppermost portion of body section 48*b*, comprised of a first plurality of slots 96 and a second plurality of slots 98 as to generally respectively meet or intersect. As best can be seen in the top plan view of FIG. 10, slots 96 are, in the main, locate on one side of a vertical plane passing through the centerline 10 while slots 98 are, in the main, on the other side of such plane. Further, each of the slots or aperture means 96 and 98 are so formed as to be generally inclined, when viewed in FIG. 10, where by their respective points of meeting or intersection are at distances closer to the abutment portion 56*b* than the distances at which their respective other ends are from the same abutment means 56*b***.

Figure 12:
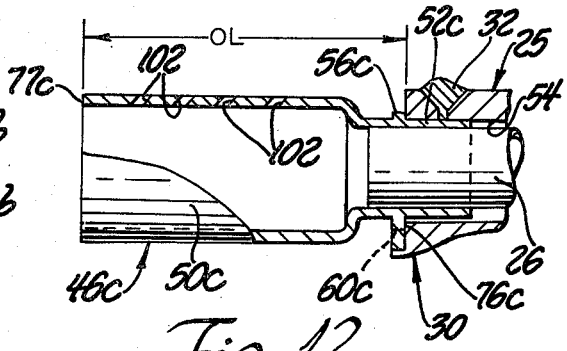
FIG. 12 is a view somewhat similar to that of FIG. 2 but illustrating a further embodiment of a muzzle brake embodying teachings of the invention.

FIG. 12, a view somewhat similar to FIG. 2, illustrate a further modification of the invention. In FIG. 12, all elements of the muzzle brake shown which are like or similar to those of FIGS. 1–11 are identified with like reference numbers provided with a suffix "c". As can be seen, in the embodiment of FIG. 12, the forward or outer body section **50*c* is of a size substantially enlarged, in cross-sectional configuration, from that of rearward or inner body section 52*c*. The venting aperture means generally typically illustrated at 102**, may be of any suitable configuration.

Figure 13:
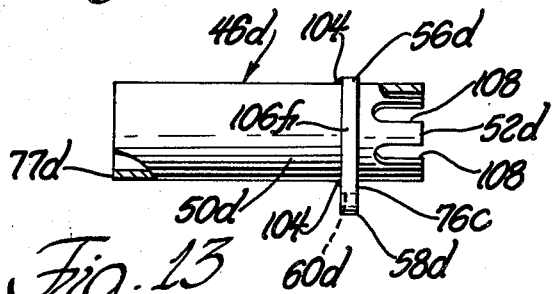
FIG. 13 is a view similar to any of FIG. 5, 9 or 11 and illustrating another manner of constructing a muzzle brake according to the invention.
Figure 14:
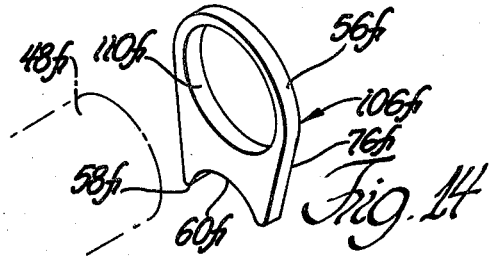
FIG. 14 is an enlarged perspective view of one element employable in constructing one particular type of muzzle brake according to the invention.

FIGS. 13 and 14 illustrate further aspects of the invention. The elements shown in FIG. 13 which are like or similar to those of FIGS. 1–12 are identified with like reference numbers provided with a suffix "d". The embodiment of FIG. 13 contemplates a muzzle brake **46*d* being comprised of, for example, three sections the outer or forward most being a tubular member 50*d* which is soldered, welded brazed (as generally depicted at 104) or otherwise secured to the abutment means 56*d* which may be comprised of a member such as that shown at 106*f* of FIG. 14. The inner or rearward tubular body section 52*d* may similarly be secured to the rear of member 106*f* as to be in alignment with body member 50*d* and member 106. Further, the embodiment of FIG. 13 contemplates the provision of cut-out portions 108 in the wall of rearward body section 52*d* as to thereby provide for some limited degree of resilient deflection thereof and enable a relatively tight fit as between the outer surface thereof and the inner surface of the pistol such as at 54 of FIG. 2 or 12. Even though not shown, the generally upper portion of forward body section 50*d*** is, of course, provided with any suitable venting aperture means as, for example, already disclosed and described.

The elements shown in FIG. 14 which are like or similar to those of FIGS. 1–13 are identified with like reference numbers provided with a suffix "f". The embodiment of FIG. 14 contemplates a muzzle brake **46*f* being comprised of a tubular body 48*f* and a member 106*f* which are cooperatively assembled and secured to each other as by, for example, brazing. That is, it is contemplated that the outer surface of tubular member 48*f* would be closely received within the cooperating inner surface 110*f* of member 106*f*** and positioned as to have a relatively longer forward body section and relatively shorter rearward body section.

Figure 15:
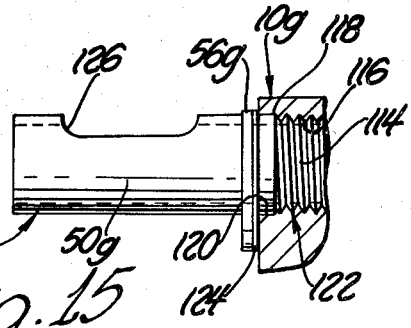
FIG. 15 is a view similar to that of FIG. 12 but illustrating a further modification of the invention.

In FIG. 15, wherein all elements of the muzzle brake shown and which are like or similar to those of the preceding Figures are identified with like reference numbers provided with a suffix "g", the rearward or inner tubular body section 112 of muzzle brake **46*g* is shown as having a threaded portion 114 which cooperatively threadably engages an internally formed threaded portion 116 of the related pistol 10*g*. Preferably, a cylindrical pilot diameter 118 is closely received by a cooperating locating or piloting cylindrical bore 120 as to obtain the best concentricity as between the internal cylindrical surface of such forward and rearward body sections 50*g* and 122 respectively with respect to the bore of the related gun barrel. If desired, suitable related shimming means 124 may be provided as between the abutment means 56*g* and the juxtaposed forward end of the pistol in order to assure that the aperture venting means, typically depicted at 126, will be positioned upwardly when the abutment means 56*g* is threadably locked against the pistol 10*g***.

Figure 16:
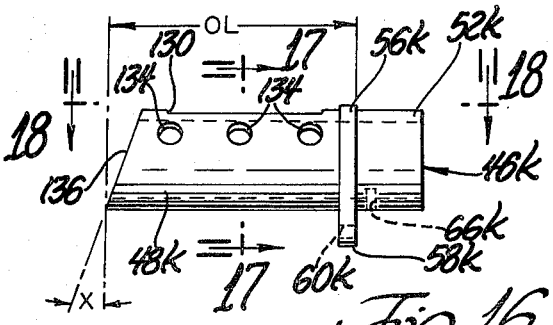
FIG. 16 is a view similar to any of FIGS. 5, 9, 11 or 13 and illustrating still another embodiment of the invention.
Figure 17:
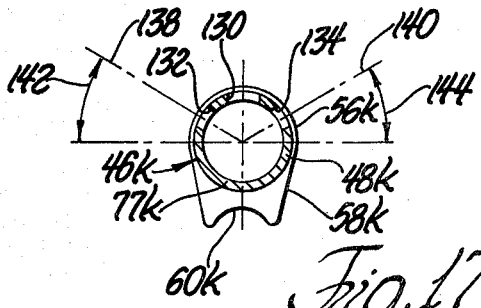
FIG. 17 is a cross-sectional view taken generally on the plane of line 17—17 of FIG. 16 and looking in the direction of the arrows.
Figure 18:
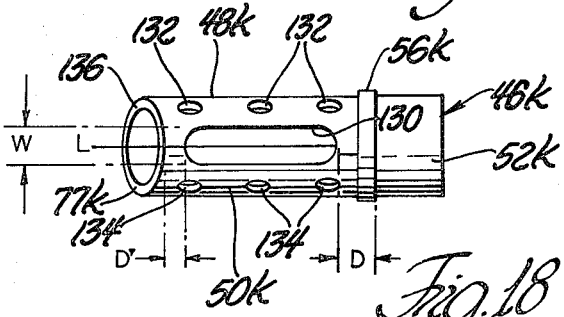
FIG. 18 is a view taken generally on the plane of line 18—18 of FIG. 16 and looking in the direction of the arrows.

FIGS. 16, 17 and 18 illustrate yet another embodiment of the invention. All elements of the shown muzzle brake which are like or similar to those of the preceding Figures are identified with like reference numbers provided with a suffix "k". The muzzle brake **46*k* is shown as comprising aperture or venting means, formed in and through the uppermost portion of forward body section 48*k* with such venting means, in turn, comprising a generally medially situated axially elongated slot 130 and a first plurality of axially spaced generally circular apertures 132, generally along one side of and spaced from such slot 130, and a second plurality of axially spaced generally circular apertures 134 along the other side of and spaced from slot 130. Further, as can also be seen, the forward most end 136 of muzzle brake 46*k* is formed as to be inclined and as to have the uppermost end thereof closer to the abutment means 56*k***.

In one particularly successful embodiment of the invention shown in FIGS. 16, 17 and 18, the angle, "X", of inclination, from the vertical, of the forward-most end 136 of muzzle brake **46*k* was in the order of magnitude of approximately 15° to 20°, while the distance, D, from the abutment surface 56*k* to the rearward end of slot 130 was in the order of magnitude of approximately ¼ inch; the length, L, of the slot 130 was in the order of magnitude of approximately 1-1/16 inches and the distance, D', from the forward-most end of the slot 130 to the top-most portion of the forward end 136 was in the order of magnitude of approximately 9/32 inch, while the width, W, of slot 130 was in the order of magnitude of approximately ¼ inch. Further, in such particularly successful embodiment, the circular apertures 132 and 134 were each in the order of magnitude of approximately 3/16 inch in diameter, substantially axially equally spaced from each other and located as to have their respective centerlines 138 and 140 at angles 142 and 144 of approximately 45° with respect to the horizontal when slot 130 is medially vertically disposed as generally depicted in FIG. 17**.

It has been found during testing and experimentation that the use of the invention provides an excellent means of effectively producing a pneumatic type brake resisting the otherwise twisting motion or upward kick usually experienced upon firing of the associated gun. That is, the gases produced upon ignition of the propellant in the bullet assembly escape, at least to a great part, through the upwardly directed aperture or venting means formed in and through the upper portion of the muzzle break. In being thusly directed upwardly, an equal and opposite pneumatic reaction force is developed downwardly against the closed lower-most portion of the forward body section tending to thereby push the forward portion of the associated gun downwardly and in such manner overcomes the force moment couple previously described and created by the firing of the gun tending to cause the gun to have said upward kick. Further, since the muzzle brake of the invention has its forward most body section disposed forwardly of the associated gun, the downward reaction forces have an increased effective lever arm which, by multiplication, increases the effective reaction force moment couple. During such testing and experimentation it has also been discovered that when the muzzle brake of the invention is employed in combination with a slide-type automatic pistol, the recoil force, as experienced by the operator, is considerably reduced or softened. This is believed to occur because the gases start to escape upwardly through the venting means of the muzzle brake before the slide of the pistol is acted upon. In comparison, without the muzzle brake of the invention, the pistol slide comes back very fast and very hard to the feel of the operator.

As may already be surmised by the disclosure hereinbefore made, the invention may be practiced in various configurations. That is, it may be a single unitary piece machined or otherwise formed as to have the desired configuration, or it may be formed of, for example, three pieces secured to each other as generally depicted in FIG. 13, or it may be formed of a single tubular member generally fitted within suitable abutment means such as depicted generally in FIG. 14. Further, although not specifically shown, it should be apparent that the muzzle brake of the invention could also be made of a single tubular member with a stepped-like shoulder or abutment portion (functionally equivalent to portion 56 of FIG. 2) machined or otherwise formed thereon.

Even though the key locking means 66 as shown in FIGS. 3, 5, 6 and 7 for purposes of clarity has not been shown in the other embodiments, such may be assumed to exist in, for example, the embodiments of FIGS. 8, 9, 10, 11, 12, 13, 14, 16, 17 and 18. This is not to say that the invention cannot be practiced without such locking means or with other types of functionally equivalent locking means.

Further, it has also been discovered that even though various embodiments of the invention are possible and produce perfectly acceptable results, in situations where the muzzle brake of the invention is employed in combination with a slide type automatic pistol, optimum results are apparently obtained when the internal diameter of the forward-most or outer body section of the muzzle brake does not exceed the outer diameter of the barrel of the slide-type pistol by more than approximately 1/10 inch.

Also, during testing and experimentation it has been determined that apparently optimum results are obtained if the effective overall length (OL) of that portion of the muzzle brake disposed forwardly of the associated gun is not greater than in the order of magnitude of 2.0 inches and not less than in the order of magnitude of $\frac{3}{4}$ inch.

Further, even though in the preferred embodiment of the invention, when employed in combination with a slide-type automatic pistol, a bearing surface such as at 68 of FIG. 2 is provided, with such bearing surface 68 having an internal diameter smaller than the internal diameters of both the forward and rearward body sections, a suitable bearing surface for the related barrel may be of substantially longer axial length as generally depicted in FIG. 12 wherein substantially the entire internal cylindrical surface 79 of the rearward or inner body section 52*c* is employed as a bearing surface for gun barrel 26.

Also, while it should be obvious that the muzzle brake of the invention may be constructed of any suitable metal such as, for example, steel or aluminum (and alloys thereof) it may not be obvious that the muzzle brake of the invention may also be constructed of plastic. During testing and experimentation it was discovered that many plastic materials are suitable. For example, and not by way of limitation, it has been found that plastic materials such as Delrin and Lexan are suitable. "Delrin" is a trademark of the E. I. duPont de Nemours & Co. of Wilmington, Delaware, for an acetal resin derived by polymerization of formaldehyde. "Delrin" acetal resin as tested by the ASTM (American Society of Testing Materials) under standard conditions exhibited a tensile strength, at 75° F., of 10,000.0 p.s.i. "Lexan" is a trademark of the General Electric Company of 1 River Road, Schenectady, N.Y. for thermoplastic carbonate-linked polymers produced by reacting bisphenol A and phosgene.

Although only a preferred embodiment and selected modifications of the invention have been disclosed and described, it is apparent that other embodiments and modifications of the invention are possible within the scope of the appended claims.

I claim:

1. A muzzle brake for use on an associated gun having gun body means, a gun barrel with a bore formed in said barrel and a gun slide surrounding said barrel and axially movable relative to said barrel, said muzzle brake comprising:

a tubular cylindrical body member having an internal passage, said internal passage having one end portion and an opposite end portion with a shoulder portion therebetween, said one end portion and said opposite end portion of said internal passage having an internal diameter of substantially constant diametral dimension and being slightly greater than the diameter of said barrel, said shoulder portion having an internal diameter slightly greater than the diameter of said barrel;

securing means for detachably securing said tubular cylindrical body member to said gun slide as to place said tubular cylindrical body member in substantial axial alignment with said barrel bore, said cylindrical body member when detachably secured to said slide having said one end portion received within said slide as to be axially movable therewith and as to have said opposite end portion projecting outwardly of said slide in substantial axial alignment with said barrel bore;

abutment means carried generally externally of and by said cylindrical body member, said abutment means being effective to operatively engage an end of said slide as to limit the axial extent to which said one end portion is received by said slide when said cylindrical body member is detachably secured to said slide;

said shoulder portion having bearing surface means axially interposed said one and said opposite end portion, said bearing surface means slidably receiving said barrel therein when said cylindrical body is detachably secured to said slide; and venting aperture means formed through the wall of said tubular cylindrical body member, said aperture means comprising an elongated slot having one end and a longitudinal axis substantially parallel to the axis of said tubular cylindrical body, said elongated slot being located ahead of the forward end of said barrel such that said barrel end is interposed said shoulder portion of the internal passage and said one end of the elongated slot, said elongated slot further being upwardly disposed and further having said longitudinal axis generally contained within a vertical plane passing through said axis of the barrel when said gun is held in a generally horizontal firing position, such that when said gun is fired, the gasses generated during the ignition of a related bullet assembly may freely escape the end of said barrel, unrestricted by the structural relationship established between said barrel and said opposite end portion of said tubular cylindrical body member toward said elongated slot and pass therethrough in a generally upwardly direction thereby creating generally downwardly directed reaction forces assisting in maintaining the fired firearm stable to at least significantly minimize the full upward kick of the fired firearm.

2. A muzzle brake according to claim 1 wherein said securing means comprises keying means detachably connectable to key-receiving means carried by said slide.

3. A muzzle brake according to claim 1 wherein said securing means comprises an axially extending threaded portion carried by said tubular body member.

4. A muzzle brake according to claim 3 wherein said threaded portion is formed externally of and on said tubular body member.

5. A muzzle brake according to claim 1 wherein said venting aperture means further comprises a first plurality of aperture means formed in said tubular cylindrical body member spaced from each other and further spaced a substantially equal distance from and along one side of said slot, and a second plurality of aperture means formed in said tubular cylindrical body member spaced from each other and further spaced a substantially equal distance from and along an opposite side of said slot, said first and second plurality of aperture means being at an elevation above a horizontal plane passing through said axis of said barrel when said tubular cylindrical body member is detachably secured to said slide, such that when said gun is fired, the gasses generated during ignition of a related bullet assembly may freely escape the end of said barrel, unrestricted by the structural relationship established between said barrel and said opposite end portion of the tubular cylindrical body member, toward said elongated slot and said first and second plurality of axial aperture means and pass therethrough in a generally upwardly direction thereby creating generally downwardly directed reaction forces assisting in maintaining the fired firearm stable to at least significantly minimize the full upward kick of the fired firearm.

6. A muzzle brake according to claim 5 wherein said first and second plurality of aperture means comprise generally circular apertures.

7. A muzzle brake according to claim 1 wherein said tubular body member comprises a first tubular body section, a second tubular body section, said first and second tubular body sections being in axial alignment with each other and respectively terminating in first and second open ends, wherein said first tubular body section has said venting aperture means formed therein, and wherein said second tubular body section is effective for connection to associated gun body means, and further comprising slot-like relief portions formed at said second open end and in the wall defining said second tubular body section, said relief portions enhancing the ability of said second tubular body section to undergo limited resilient deformation.

8. A muzzle brake according to claim 4 wherein said first and second tubular body sections are of cylindrical configuration, and wherein the respective outer diameters of said first and second tubular body sections are equal to each other.

9. A muzzle brake according to claim 1 wherein said tubular body member is formed of plastic material.

10. A muzzle brake according to claim 1 and further comprising lever arm means carried by said tubular body member, said lever arm means being effective upon assembly of said tubular body member to said gun body means for operatively engaging associated abutment means carried by said gun body means to prevent rotation of said tubular body member about the tubular axis thereof.

11. A muzzle brake according to claim 10 wherein said associated abutment means comprises a recoil spring plug carried by said slide, and wherein said lever arm means comprises a swingable end of yoke-like configuration effective to engage said plug in a manner as to function as a fixed seat for said plug and to prevent swingable movement of said swingable end.

12. A muzzle brake according to claim 1 wherein said opposite end portion of said tubular cylindrical body member axially terminates in an end place inclined with respect to the vertical and being formed as to have the upper-most portion thereof closer to said slide when said tubular cylindrical body member is detachably secured to said slide.

13. A muzzle brake according to claim 12 wherein said axial end surface is so inclined as to form an angle of about 15° to 20° with respect to the vertical.

* * * * *

UNITED STATES PATENT OFFICE

CERTIFICATE OF CORRECTION

Patent No. 4,207,799 Dated June 17, 1980

Inventor(s) Charles T. Tocco

It is certified that error appears in the above-identified patent and that said Letters Patent are hereby corrected as shown below:

Column 3, line 40, delete the word "of" second occurrence.

Column 5, line 3, delete the numeral "10" and insert therefor ----100----.

Signed and Sealed this

*Thirteenth* Day of *January 1981*

[SEAL]

*Attest:*

SIDNEY A. DIAMOND

*Attesting Officer*

*Commissioner of Patents and Trademarks*